US011465034B2

(12) United States Patent
Sharp

(10) Patent No.: US 11,465,034 B2
(45) Date of Patent: Oct. 11, 2022

(54) PROTECTIVE GLOVE

(71) Applicant: Matthew Sharp, Henley-in-Arden (GB)

(72) Inventor: Matthew Sharp, Henley-in-Arden (GB)

( * ) Notice: Subject to any disclaimer, the term of this patent is extended or adjusted under 35 U.S.C. 154(b) by 230 days.

(21) Appl. No.: 15/815,078

(22) Filed: Nov. 16, 2017

(65) Prior Publication Data

US 2018/0133582 A1 May 17, 2018

(30) Foreign Application Priority Data

Nov. 16, 2016 (GB) ..... 1619406

(51) Int. Cl.
*A63B 71/14* (2006.01)
*A41D 13/08* (2006.01)
*A41F 1/06* (2006.01)

(52) U.S. Cl.
CPC ..... *A63B 71/145* (2013.01); *A41D 13/084* (2013.01); *A41D 13/088* (2013.01); *A41F 1/06* (2013.01); *A63B 2209/10* (2013.01); *A63B 2244/102* (2013.01)

(58) Field of Classification Search
CPC .... A41F 1/06; A63B 71/145; A63B 2244/102
See application file for complete search history.

(56) References Cited

U.S. PATENT DOCUMENTS 1,286,396 A * 12/1918 Oldham ..... A63B 71/145 2/18
1,469,315 A 10/1923 Hansard
2,083,604 A * 6/1937 Hay ..... A63B 71/146 2/161.2
2,416,444 A * 2/1947 Hilton ..... A63B 71/145 2/18
2,493,977 A * 1/1950 Kochman ..... A63B 71/145 2/160
2,740,120 A * 4/1956 Temple ..... A63B 71/145 2/18

(Continued)

FOREIGN PATENT DOCUMENTS

DE 29913345 U1 10/1999
DE 29913356 U1 11/1999

(Continued)

OTHER PUBLICATIONS

Search Report for Application No. GB1619406.0, dated Mar. 20, 2017 (5 Pages).

(Continued)

*Primary Examiner* — Richale L Quinn
(74) *Attorney, Agent, or Firm* — Brown Rudnick LLP

(57) ABSTRACT

A protective glove (100) is disclosed, comprising: a wrist section (200) for protecting a wrist of a wearer of the glove (100); a hand section (300) attached to an end of the wrist section (200), the hand section (300) for protecting the hand of a wearer of the glove (100). The hand section (300) comprises a knuckle section (304) for protecting the knuckles of a wearer of the glove (100). The glove (100) further comprises a knuckle compressor (900) is configured to compress the knuckle section (304), and comprises at least one strap (901) extending between a palm side of the hand section (300) and a back side of the hand section (300). The at least one strap (901) is configured to compress the knuckle section (304).

13 Claims, 8 Drawing Sheets

(56) References Cited

U.S. PATENT DOCUMENTS 2,852,779 A * 9/1958 Roessler ..... A63B 71/146 2/161.1
3,105,972 A * 10/1963 Christopher ..... A63B 71/146 446/901
3,559,212 A * 2/1971 Skovron ..... A63B 71/146 2/161.3
3,568,212 A * 3/1971 Seaborn ..... A63B 71/145 2/18
3,606,343 A * 9/1971 Lemon ..... A63B 71/146 473/213
3,855,633 A * 12/1974 Rhee ..... A63B 71/145 473/518
4,698,850 A * 10/1987 Patton, Sr ..... A61F 4/00 482/106
4,796,306 A * 1/1989 Mitchell ..... A63B 71/148 2/163
4,809,366 A * 3/1989 Pratt ..... A41D 20/00 D29/113
4,815,147 A * 3/1989 Gazzano ..... A63B 71/143 2/161.1
4,949,711 A * 8/1990 Gyovai ..... A63B 21/023 601/40
4,984,300 A * 1/1991 Cho ..... A63B 71/145 2/18
5,022,094 A * 6/1991 Hames ..... A41D 19/01547 2/163
5,079,776 A * 1/1992 Crawford ..... A63B 71/141 2/167
5,224,220 A * 7/1993 Andriola ..... A41D 19/0024 2/163
5,313,667 A * 5/1994 Levine ..... A41D 13/088 2/160
5,413,554 A * 5/1995 Trueman ..... A63B 21/151 601/40
5,414,868 A * 5/1995 Crawford ..... A63B 71/146 2/160
5,435,013 A * 7/1995 Davis ..... A63B 71/146 2/163
5,447,490 A * 9/1995 Fula ..... A63B 21/0004 601/40
5,492,331 A * 2/1996 Kawakami ..... A63B 71/146 473/212
5,669,073 A * 9/1997 Pellington ..... A63B 71/146 2/160
5,685,809 A * 11/1997 Murray ..... A63B 21/4019 2/161.4
5,697,103 A * 12/1997 Wiggins ..... A41D 19/00 2/163
5,781,928 A 7/1998 Avila
5,820,577 A * 10/1998 Taylor ..... A63B 21/4025 601/40
5,846,168 A * 12/1998 Murray ..... A63B 21/4021 2/161.4
5,876,363 A * 3/1999 Marx ..... A61F 5/0118 601/40
6,073,269 A * 6/2000 Diaco ..... A63B 71/146 2/160
6,093,165 A * 7/2000 Estwanik ..... A63B 71/145 2/161.7
6,119,267 A * 9/2000 Pozzi ..... A63B 71/145 2/161.1
6,393,615 B1 * 5/2002 Bedell ..... A41D 19/01547 2/161.1
6,458,091 B1 * 10/2002 Parker ..... A61H 1/0266 602/22
6,526,592 B1 * 3/2003 Best ..... A41D 19/01588 2/161.1
6,553,576 B1 * 4/2003 Knapp ..... A41D 19/01547 2/163
7,051,377 B1 * 5/2006 Milner ..... A63B 71/141 2/161.6
7,056,298 B1 * 6/2006 Weber ..... A61F 5/0118 2/21
7,234,172 B1 * 6/2007 Hoelscher ..... A41D 19/01582 2/163
7,406,720 B2 * 8/2008 Hoelscher ..... A41D 19/01588 2/163
7,582,030 B2 * 9/2009 LaPergola ..... A63B 69/0071 473/464
7,856,670 B1 * 12/2010 Hazuga ..... A63B 23/16 2/163
8,814,812 B2 * 8/2014 Armstrong ..... A61H 1/0288 601/40
8,888,724 B2 * 11/2014 Armstrong ..... A61H 1/0288 601/40
8,966,664 B2 * 3/2015 Walsh ..... A63B 71/146 2/17
9,079,093 B2 * 7/2015 Clement ..... A63B 71/145
9,380,820 B1 * 7/2016 Griego ..... A63B 21/00
10,004,975 B2 * 6/2018 Clement ..... A63B 71/145
10,080,392 B2 * 9/2018 McCully ..... A63B 71/145
10,376,770 B2 * 8/2019 Wittman ..... A63B 71/145
10,672,291 B2 * 6/2020 Raimondi ..... G09B 15/06
10,677,560 B2 * 6/2020 Neyra ..... F41C 33/001
2009/0019617 A1 * 1/2009 Dillenschneider ... A63B 71/141 2/158
2009/0192420 A1 * 7/2009 Armstrong ..... A61H 1/0288 601/40
2010/0100998 A1 * 4/2010 Lisa ..... A63B 71/146 2/161.2
2012/0210484 A1 * 8/2012 Clement ..... A63B 71/145 2/18
2012/0210485 A1 * 8/2012 Clement ..... A63B 71/145 2/20
2013/0198920 A1 * 8/2013 Wittman ..... A63B 71/145 2/16
2014/0215675 A1 * 8/2014 Clauder ..... A63B 71/145 2/18
2016/0051883 A1 * 2/2016 Clement ..... A63B 71/145 2/161.1
2016/0367881 A1 * 12/2016 Le ..... A41F 1/06
2017/0001097 A1 * 1/2017 Ferrer ..... A63B 71/145
2017/0173442 A1 * 6/2017 Hemara ..... A63B 71/14
2017/0282048 A1 * 10/2017 Wittman ..... A63B 71/145
2018/0027893 A1 * 2/2018 Bangera ..... A41D 13/0506
2018/0369679 A1 * 12/2018 Barton ..... A63B 71/145

FOREIGN PATENT DOCUMENTS

EP 1072202 A2 1/2001
WO 1992008379 A1 5/1992
WO 9848744 A1 11/1998

OTHER PUBLICATIONS

Examination Report for Application No. GB1619406.0, dated Aug. 17, 2017 (3 Pages).
Search Report for Application No. GB1718993.7, dated Mar. 15, 2018 (4 Pages).
Examination Report for Application No. GB1718993.7, dated May 10, 2021 (2 Pages).
Examination Report for Application No. GB1718993.7, dated Feb. 3, 2021 (5 Pages).
Combined Search and Examination Report for Application No. GB2100832.1, dated Feb. 26, 2021 (5 Pages).

* cited by examiner

PROTECTIVE GLOVE

RELATED APPLICATIONS

This application claims priority to United Kingdom patent application number GB1619406.0, filed Nov. 16, 2016, the entirety of which is incorporated herein by reference.

FIELD OF THE INVENTION

The invention relates to a protective glove, in particular to a protective inner glove for use in boxing.

BACKGROUND

Hand wraps are conventionally used in boxing and other combat sports to protect the hand and wrist against injuries induced by punching. A hand wrap comprises a strip of cloth wrapped securely around the wrist and palm of a boxer and worn under a boxing glove. The hand wrap serves to align joints and compress the tissue of the hand.

Although hand wraps are considered to provide the best combination of comfort and protection, it can be very difficult for individual boxers to apply the wrap themselves and can take several minutes. Amateur boxers in particular are unlikely to have a trainer available to apply the wrapping for them on a daily basis.

To overcome this problem, one-size-fits-all type under-gloves have been used. However, these gloves are not customizable, so therefore do not replicate the secure fit of traditional hand wraps nor provide the necessary protection needed. A good fit is important for minimizing the chance of injury.

SUMMARY OF THE INVENTION

In accordance with the invention there is provided a protective glove comprising: a wrist section for protecting a wrist of a wearer of the glove; a hand section attached to an end of the wrist section, the hand section for protecting the hand of a wearer of the glove, wherein the hand section comprises a knuckle section for protecting the knuckles of a wearer of the glove; and a knuckle compressor configured to compress the knuckle section, wherein the knuckle compressor comprises at least one strap extending between a palm side of the hand section and a back side of the hand section, the at least one strap configured to compress the knuckle section.

By moving the tongue, a wearer can customize the support provided to the wrist. Some wearers may prefer the tongue to be positioned higher up towards or into the hand section. This may for example prevent the wrist bending, and so provide more support. Other wearers may prefer the tongue to be lower down, away from the hand section. The moveable tongue allows the glove to be customized to provide a comfortable and protective fit for the wearer, which is not provided by the one-size-fits-all style gloves.

In some embodiments the hand section may comprise a knuckle section for protecting the knuckles of a wearer of the glove. The glove may further comprise a knuckle compressor configured to compress the knuckle section. The compression applied by the knuckle compressor may be adjustable by the wearer of the glove.

The knuckles sustain a large impact during a punch. The knuckle section provides extra protection for this area. Compressing the knuckle section with the knuckle compressor tightens the knuckle section around the knuckles, providing better protection during an impact. Allowing the wearer to adjust the amount of compression applied ensures that the knuckle section fits tightly around that particular wearer's hand, and provides a protection suitable for their needs. Furthermore the compression straps once secured significantly limits any unwanted movement of the fabric, preventing sores and blistering in-between the fingers.

In some embodiments the knuckle compressor may comprise at least one strap extending between a palm side of the hand section and a back side of the hand section, the at least one strap configured to compress a back (or knuckle) side of the knuckle section. For example, the at least one strap may extend from a knuckle side of the hand, and down through a hoop on the palm side of the hand where it is pulled to a desired compression and then held in place, e.g. fixed back with a hook and loop fastener such as Velcro™ on the backside/knuckle side of the hand. The strap may be any elongate material, such as a cord, lace or a wire.

The at least one strap may be adjustably attached to the hand section or the wrist section, and the compression applied to the knuckle section may be adjustable by adjusting the attachment of the strap to the hand section or the wrist section.

In some embodiments the knuckle section may comprise a pad of protective material adapted to protect the knuckles of a wearer. For example the protective material may comprise a non-Newtonian fluid. The pad of protective material provides extra protection for the knuckles, dampening the impact of a punch. A non-Newtonian fluid is particularly advantageous as a protective material. During the impact of a punch, the non-Newtonian fluid hardens, protecting the knuckles. At other times the non-Newtonian fluid is flexible, providing a more comfortable and better fitting glove.

Some embodiments of the glove may further comprise an adjustable fastener for tightening the wrist section around wrist of a wearer. The adjustable fastener provides a further level of customization to the glove. A wearer can tighten the wrist section so that it comfortably fits their wrist. A comfortable and customized fit is important for providing optimal support to the wrist.

In some embodiments the wrist section may comprise a wrist covering having a first wrist covering edge and a second wrist covering edge, the wrist covering adapted to extend partially around the wrist of a wearer. The adjustable fastener may connect the first wrist covering edge and the second wrist covering edge and may be operable to pull the first wrist covering edge and second wrist covering edge towards each other to tighten the wrist section around the wrist of a wearer.

The tongue may extend at least between the first wrist covering edge and the second wrist covering edge of the wrist covering. In particular, the tongue may extend underneath the first wrist covering edge and the second wrist covering edge. Tightening the wrist section around a wrist may thus also hold the tongue in its wearer-selected position. Thus by fastening the adjustable fastener, the wearer may secure both the wrist covering and the tongue.

In some embodiments the tongue may be attached to the adjustable fastener. This may provide a connection between the tongue and the rest of the glove, so that the tongue is not easily lost, whilst still allowing the tongue to move relative to the wrist section.

The adjustable fastener may comprise: a lace passing through at least one lace guide on the first wrist covering edge and at least one lace guide of the second wrist covering edge; and a lace fastener preventing movement of the lace through the lace guides. In particular, a first plurality of lace guides may be attached to the first wrist covering edge, and a second plurality of lace guides may be attached to the second wrist covering edge. The lace may pass from a first lace guide of the first plurality to a first lace guide of the second plurality, and then to a second lace guide of the first plurality, and then to a second lace guide of the second plurality of lace guides, for example in the manner of shoe laces.

In some embodiments, the adjustable fastener is operable to tighten the wrist section and the hand section. Just as a comfortable, custom fit of the wrist section is important for protecting a wrist, so a comfortable, custom fit of the hand section is important for protecting the hand. In these embodiments a wearer may tighten both the wrist section and the hand section using the same adjustable fastener. The glove is therefore highly customizable, whilst also being easy to operate, which is important if the wearer is putting the glove on without assistance. In alternative embodiments, the glove may comprise a first adjustable fastener and a second adjustable fastener: the first adjustable fastener operable to tighten the wrist section; and the second adjustable fastener operable to tighten the hand section.

In some embodiments, the hand section may comprise a hand covering having a first hand covering edge and a second hand covering edge. The hand covering may be configured to extend partially around the hand of a wearer. The adjustable fastener may connect the first hand covering edge and the second hand covering edge of the hand section, and may be operable to pull the first hand covering edge and second hand covering edge of the hand section towards each other. The lace of the adjustable fastener may pass through at least one lace guide on the first hand covering edge of the hand covering, and through at least one lace guide on the second hand covering edge of the hand covering.

The first hand covering edge and second hand covering edge of the hand covering meet to define a continuous hand covering edge. For example the first hand covering edge and the second hand covering edge of the hand section may form a single, substantially circular edge. The first hand covering edge of the hand section may be attached to the first wrist covering edge of the wrist section, and the second hand covering edge of the hand section may be attached to the second wrist covering edge of the wrist section. The lace may pass from a last lace guide (i.e. nearest the hand section) of the first plurality of lace guides on the first wrist covering edge of the wrist section to a first lace guide (i.e. nearest the wrist section) of a third plurality of lace guides on the first hand covering edge of the hand section. The lace may pass from the first lace guide of the third plurality through each of the lace guides of the third plurality in turn. The lace may pass from the final lace guide (i.e. furthest from the wrist section) of the third plurality to a first lace guide (i.e. furthest from the wrist section) of a fourth plurality of lace guides on the second hand covering edge of the hand section. The lace may pass from the first lace guide of the fourth plurality through each of the lace guides of the fourth plurality in turn. The lace may pass from the last lace guide (i.e. nearest the wrist section) of the fourth plurality to the last lace guide (i.e. nearest the hand section) of the second plurality of lace guides on the second wrist covering edge of the wrist section. The lace may pass through a lace guide on the tongue when passing between a lace guide of the wrist section and a lace guide of the hand section.

In some embodiments the glove may predominantly be formed of a breathable material, and/or the tongue may be a breathable material. In particular the breathable material may be spacer fabric, such as poly fibers. This may provide some additional protection for the hand of the user.

In some embodiments the glove may further comprise a wrist strap for securing or the wrist section onto a wrist of a wearer.

In some embodiments the glove may be an inner glove for boxing.

According to a second aspect of the present invention, there is provided a protective glove comprising: a wrist section for protecting a wrist of a wearer of the glove; a hand section attached to an end of the wrist section, the hand section for protecting the hand of a wearer of the glove, wherein the hand section comprises a knuckle section for protecting the knuckles of a wearer of the glove; a knuckle compressor configured to compress the knuckle section, wherein the knuckle compressor comprises at least one strap extending between a palm side of the hand section and a back side of the hand section, the at least one strap configured to compress a back side of the knuckle section, and the at least one strap being releasably attached to the back side of the knuckle section.

In some embodiments the glove may further comprise a semi-rigid wrist-support tongue moveable along the wrist section towards the hand section to a position selected by the wearer, the tongue held in use at least in part by the wrist section According to a third aspect of the present invention, there is provided a glove for protecting hands, said glove comprising: a wrist section for protecting a wrist of a wearer of the glove; a hand section attached to an end of the wrist section, the hand section for protecting the hand of a wearer of the glove, wherein the hand section comprises a mouthed knuckle section for receiving fingers of the wearer and for protecting the knuckles of the wearer of the glove; and a plurality of straps dividing the mouthed knuckle section at least partially into individual finger sections, said straps releasably attachable to the glove to compress the mouthed knuckle section.

It can be appreciated that although described above and below as releasably attachable to the back-side of the glove, the straps may be releasably attached to the inner side of the glove.

In embodiments, the glove further comprises a compressive strap for securing the thumb of a wearer. In use, the compressive strap helps to secure the thumb against the fingers of the wearer when the wearer forms a closed fist. The compressive strap may comprise an elasticated thumb loop for receiving the thumb of a wearer.

It can be appreciated that all described gloves of any aspect may be worn underneath boxing gloves.

Embodiments of the first, second or third aspect may comprise any element of any embodiment of the other aspects of the invention.

DETAILED DESCRIPTION

The invention is described in further detail below by way of example and with reference to the accompanying drawings, in which:

FIG. 6 shows an alternative embodiment of the glove of FIG. 5; and

Figure 1:
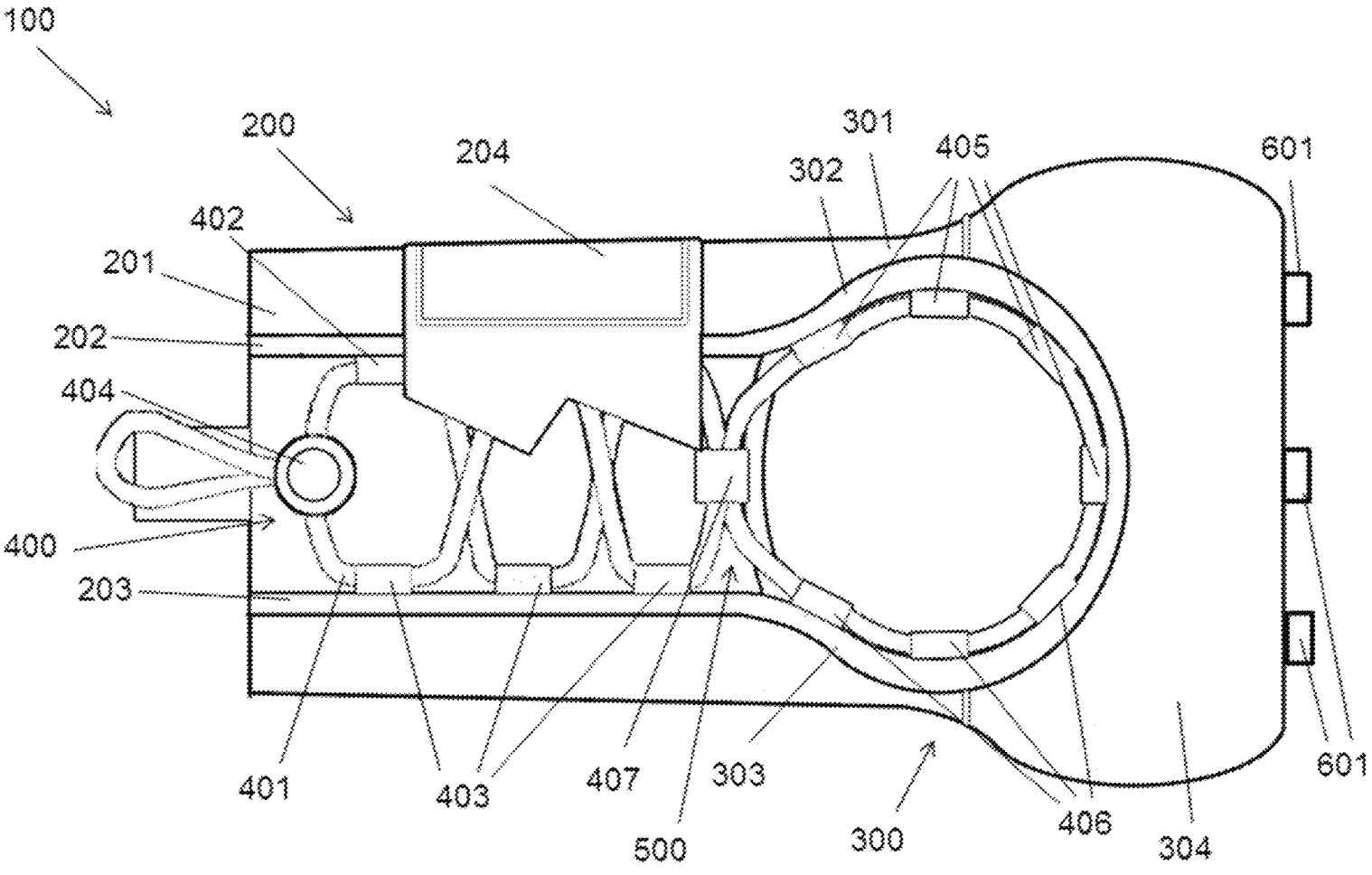
FIG. 1 is a schematic representation of an exemplary protective glove according to the invention.
Figure 7A:
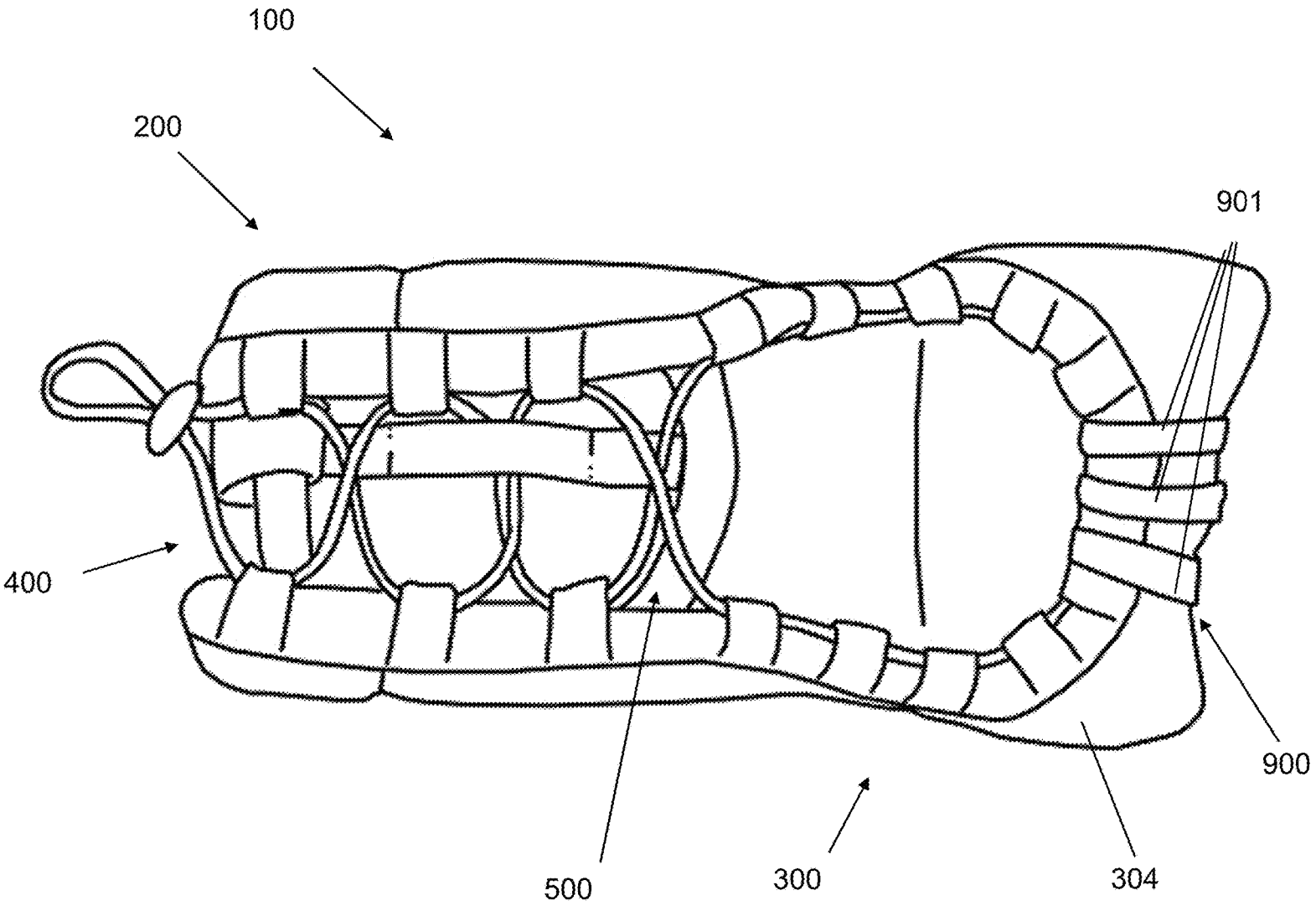
Figure 7B:
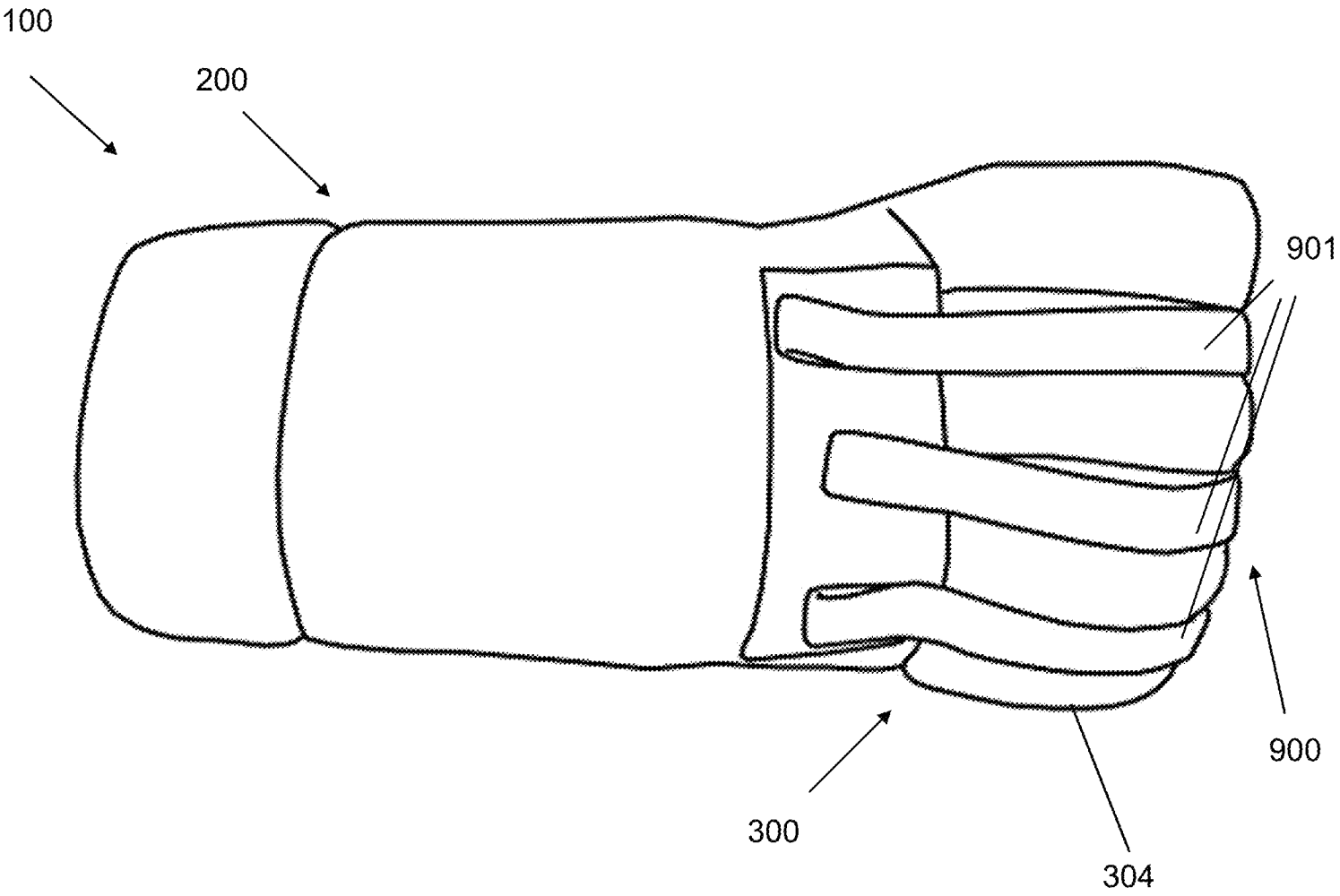

FIGS. 7*a* and 7*b* show an alternative embodiment of the glove of FIG. 1.

FIG. 1 shows a palm-side view of an exemplary protective glove 100. Glove 100 comprises a wrist section 200 and a hand section 300. The wrist section 200 comprises a wrist covering 201 adapted to wrap partially around a wearer's wrist. The wrist covering comprises a first wrist covering wrist covering edge 202 and a second wrist covering wrist covering edge 203. In use, the wrist covering 201 primarily covers and protects the top side of a wearer's wrist, with the opening between the first and second wrist covering edges 202, 203 located on the underside of the wrist.

An adjustable fastener 400 binds the two edges 202, 203 of the wrist covering 201 together, in use tightening the wrist section 200 around a wrist. In the illustrated example the fastener comprises a cord or lace 401 and a plurality of lace guides or lace guides 402, 403. A first plurality of lace guides 402 are attached to the first wrist covering edge 202 of the wrist covering 201; and a second plurality of lace guides 403 are attached to the second wrist covering edge 203 of the wrist covering 201. The lace 401 passes through each of the lace guides 402, 403, passing from a lace guide 402 on the first wrist covering edge 202 to a lace guide 403 on the second wrist covering edge 203 in the manner of shoe laces. Pulling the ends of the lace 401 passing through the last lace guides 402, 403 (i.e. the lace guides furthest from hand section 300) pulls the first wrist covering edge 202 and second wrist covering edge 203 together, tightening the wrist section 200 around a wrist. A fastener 404 holds the two ends of the lace 401, preventing the lace from loosening. The cord or lace 401 may be any elongate material, such as string or lace. The fastener 404 may be any suitable adjustable fastening means, including a knot, pull-cord, a toggle fastener, a boa fastener etc.

In the illustrated example, the adjustable fastener 400 also tightens the hand section 300. The hand section 300 comprises a hand covering 301 having a first hand covering edge 302 and a second hand covering edge 303. The first hand covering edge 302 and the second hand covering edge 303 are configured to meet to form a continuous, generally circular, hand covering edge around a palm of a wearer's hand. The first hand covering edge 302 and the second hand covering edge 303 of the hand section 300 also attach to the first wrist covering edge 202 and second wrist covering edge 203 respectively of the wrist section 200.

A plurality of lace guides 405, 406 are attached to the first 302 and second 303 edges respectively of the hand covering 301. The lace 401 passes through these lace guides 405,406 in turn; passing from one lace guide 405 on the first hand covering edge 302 to an adjacent lace guide 405 on the first hand covering edge 302. When the lace 401 has passed through each lace guide 405 on the first hand covering edge 302, it passes through a lace guide 406 on the second hand covering edge 303 adjacent to the last lace guide 405 on the first hand covering edge 302. The lace 401 then passes through each lace guide 406 on the second hand covering edge 303 in turn. Alternatively the lace 401 may alternate between hoops 405 of the first hand covering edge 302 and hoops 406 of the second hand covering edge 303, as described for the wrist section 200 above.

The glove 100 further comprises a semi-rigid tongue 500. The tongue 500 extends partially along the wrist of a wearer, and wraps partially around the wrist, particularly covering the gap between, and extending under, the first wrist covering edge 202 and second wrist covering edge 203 of the wrist covering 201. In use the tongue 500 supports a wearer's wrist upon compression (such as when the wrist is bent downwards).

Advantageously, tongue 500 is free to move relative to the wrist covering 201. A wearer can customize the glove 100 by moving the tongue 500. Some wearers may prefer the tongue 500 to be placed higher up, towards or into the hand section 300. Other wearers may prefer the tongue section 500 to be further away from the hand section 500.

When putting on glove 100, a wearer first positions the tongue 500, and then tightens the wrist and hand sections 200, 300 by pulling the ends of the lace 401 down away from the hand section 300, as described above. As the first wrist covering edge 202 and second wrist covering edge 203 of the wrist section 200 overlap the tongue 500, tightening of the wrist section 200 also secures the tongue 500 in the selected position.

In the example shown, the tongue 500 is also attached to the adjustable fastener 300. A lace guide 407 is attached to the tongue 500. Lace 401 passes through the hoop 407. This attachment allows the tongue 500 to move relative to the wrist section 200 when the fastener 400 is loose, but also ensures the tongue 500 is physically attached to the rest of the glove 100—so the tongue 500 isn't lost when the glove 100 is not in use, for example. In the illustrated example, the lace guide 407 is located at the hand section-end of the tongue 500. The lace 401 passes through hoop 407 once before passing through lace guides 405, and again after passing through lace guides 406.

Figure 2:
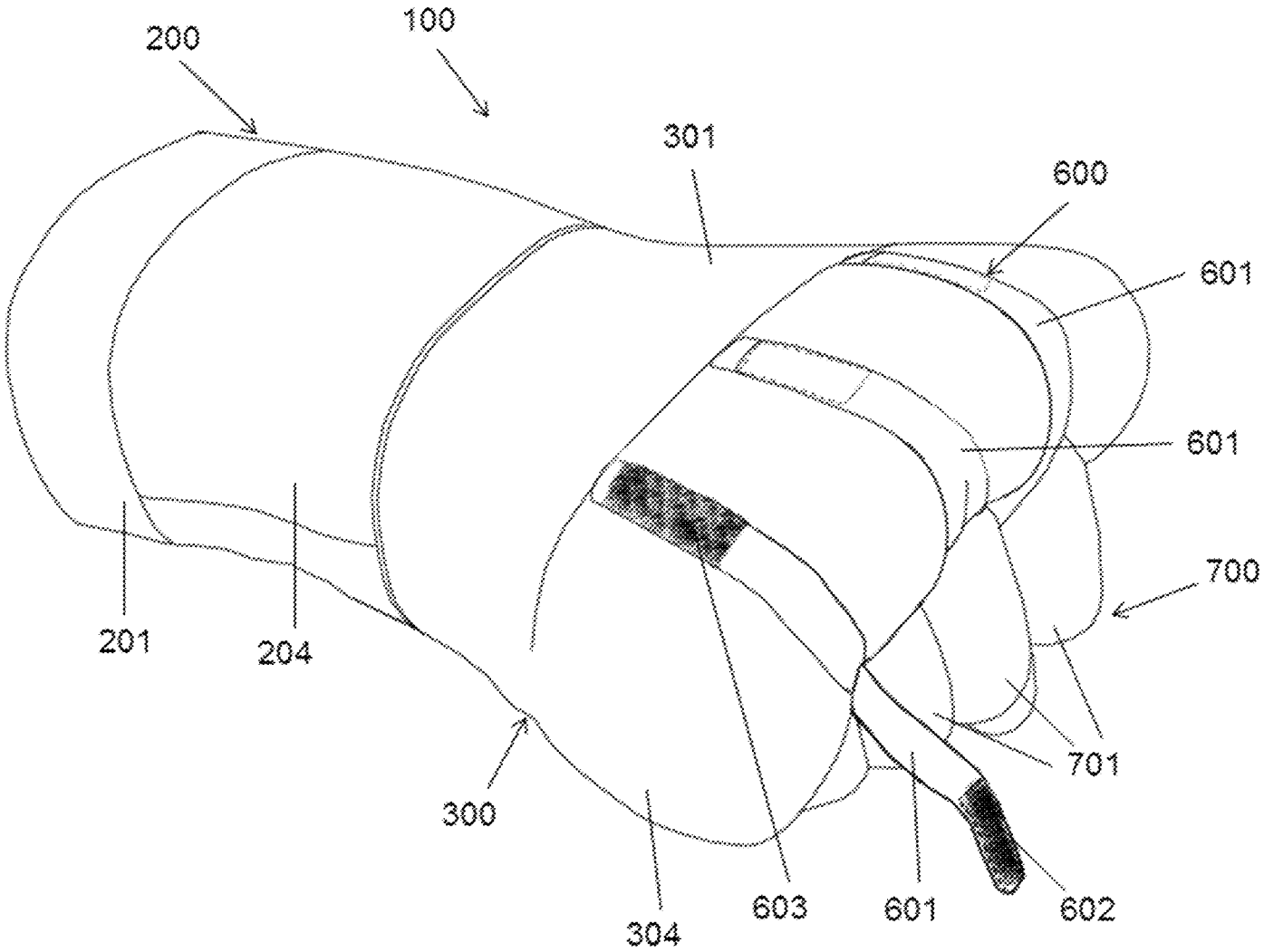
FIG. 2 is an alternative view of the glove of FIG. 1, shown on a wearer's hand.

As is best shown in FIG. 2, hand section 300 also comprises a knuckle section 304. The knuckle section 304 comprises a mouthed section for receiving fingers of a wearer. Finger dividers may be provided and/or straps used to secure and compress the knuckle section 304 may act as finger dividers. By a mouthed section it is intended to mean that the knuckle section forms a hoop or ring of material that surrounds the knuckles of a wearer and the upper portion of a wearer's palm, below the fingers, whilst allowing fingers to pass through the hoop.

The knuckle section 304 comprises a padded area, providing extra protection for a wearer's knuckles during a punch. In particular, knuckle section 304 may comprises a pad of protective material, such as a non-Newtonian fluid, which solidifies upon impact, thus protecting the knuckles during a punch whilst still allowing flexibility at other times.

The glove 100 further comprises a knuckle compressor 600. The knuckle compressor 600 compresses the knuckle section 304. Compressing the knuckle section provides increased protection for the knuckles. The knuckle compressor comprises at least one—three in the illustrated example—strap 601. The straps 601 extend from the palm side to the back side of the knuckle section 304 (i.e. from the side of the knuckle section adapted to be adjacent to the palm of a wearer's hand to the side of the knuckle section adapted to be adjacent to the back of a wearer's hand). In the example illustrated in FIG. 2 the straps 601 are fixedly attached to the palm side of the knuckle section 304. The fixed attachment of straps 601 to the palm side of the knuckle section 304 is shown for example in FIG. 1.

The straps 601 are adjustably attached to the back side of the knuckle section 304. In alternative examples the straps may adjustably attach to any part of the back side of the glove 100, for example the hand section 300 or the wrist section 200. The attached straps 601 compress the part of the knuckle section 304 between their attachment to the palm side of the knuckle section 304 and their adjustable attachment. In alternative examples the straps 601 may be fixedly attached to the back side of the glove 100 and adjustably attached to the palm side of the glove 100, or may be adjustably attached to both sides of the glove 100.

The adjustable attachment may be provided by a hook and loop fastener—for example an elongate hook fastener 602 on the straps 601 and a correspondingly positioned elongate loop fastener 603 on the back side of the glove 100. As the fasteners 602, 603 are elongate; the straps 601 can be attached to the back side of the glove 100 in a range of positions. A wearer may therefore customize the compression applied to the knuckle section 304 by altering the relative positions of each hook and loop fasteners pair 602, 603.

As shown in FIG. 2, the knuckle section 304 wraps fully around a wearer's hand 700, forming an opening at the far end of the glove 100. A wearer's fingers 701 pass through this opening. The straps 601 stretch across the opening, and are spaced along the opening so that in use the straps 601 pass between the wearer's fingers 701.

Figure 3:
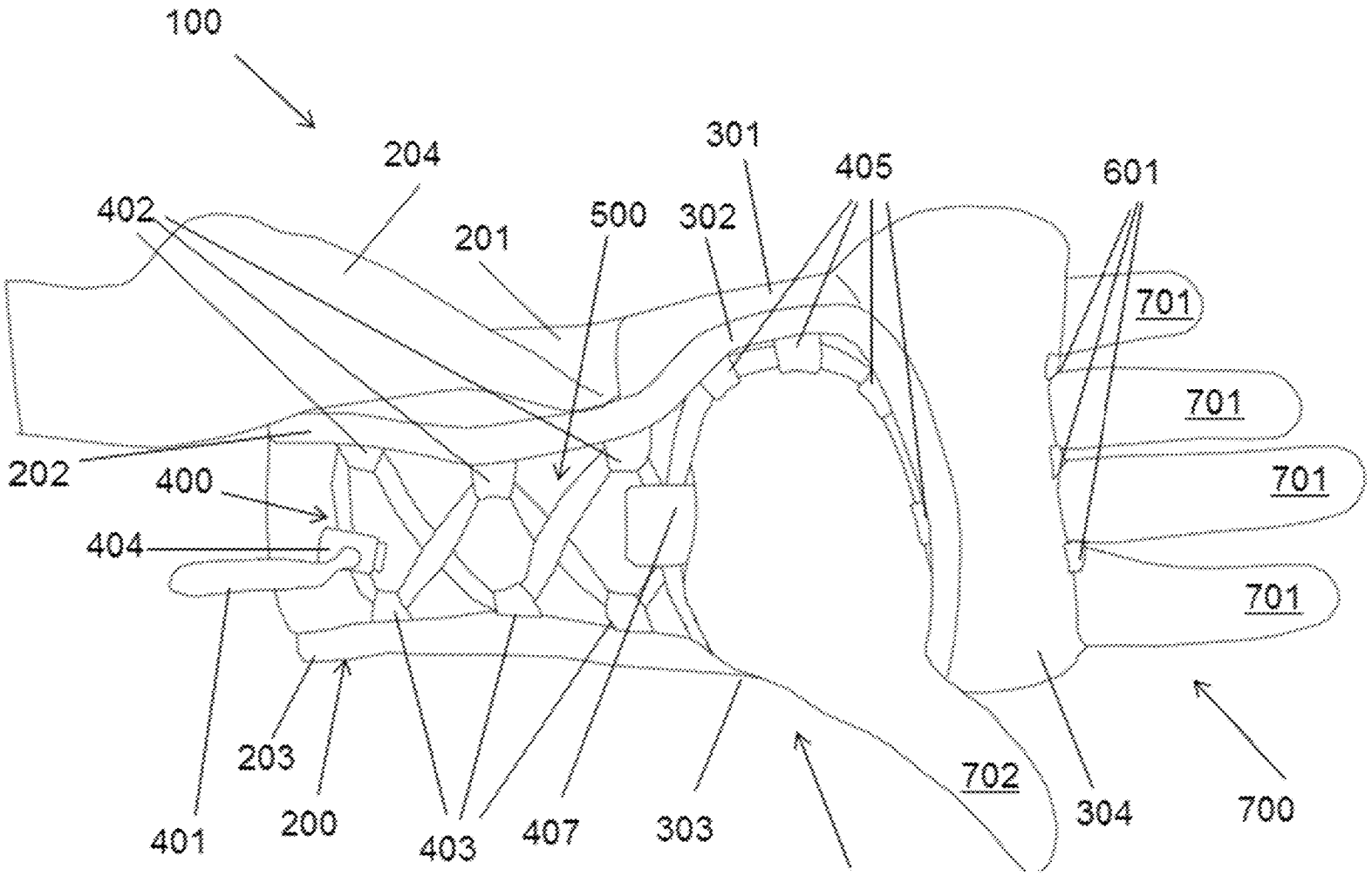
FIG. 3 is a further alternative view of the glove of FIG. 1, shown on a wearer's hand.

FIG. 3 shows an alternative view of the glove 100 on a wearer's hand 700. As can be seen in this figure, it is only the fingers 701 of the wearer that pass through the opening at the end of the knuckle section 304. The thumb 702 passes through the gap between the first hand covering edge 302 and second hand covering edge 303 of the hand section 300. Typically the thumb is separate from the knuckle section 304. A separate compressive wrap may then be used to secure and protect the thumb. Said wrap may be wrapped around the glove 100 to provide further securing.

Figure 4:
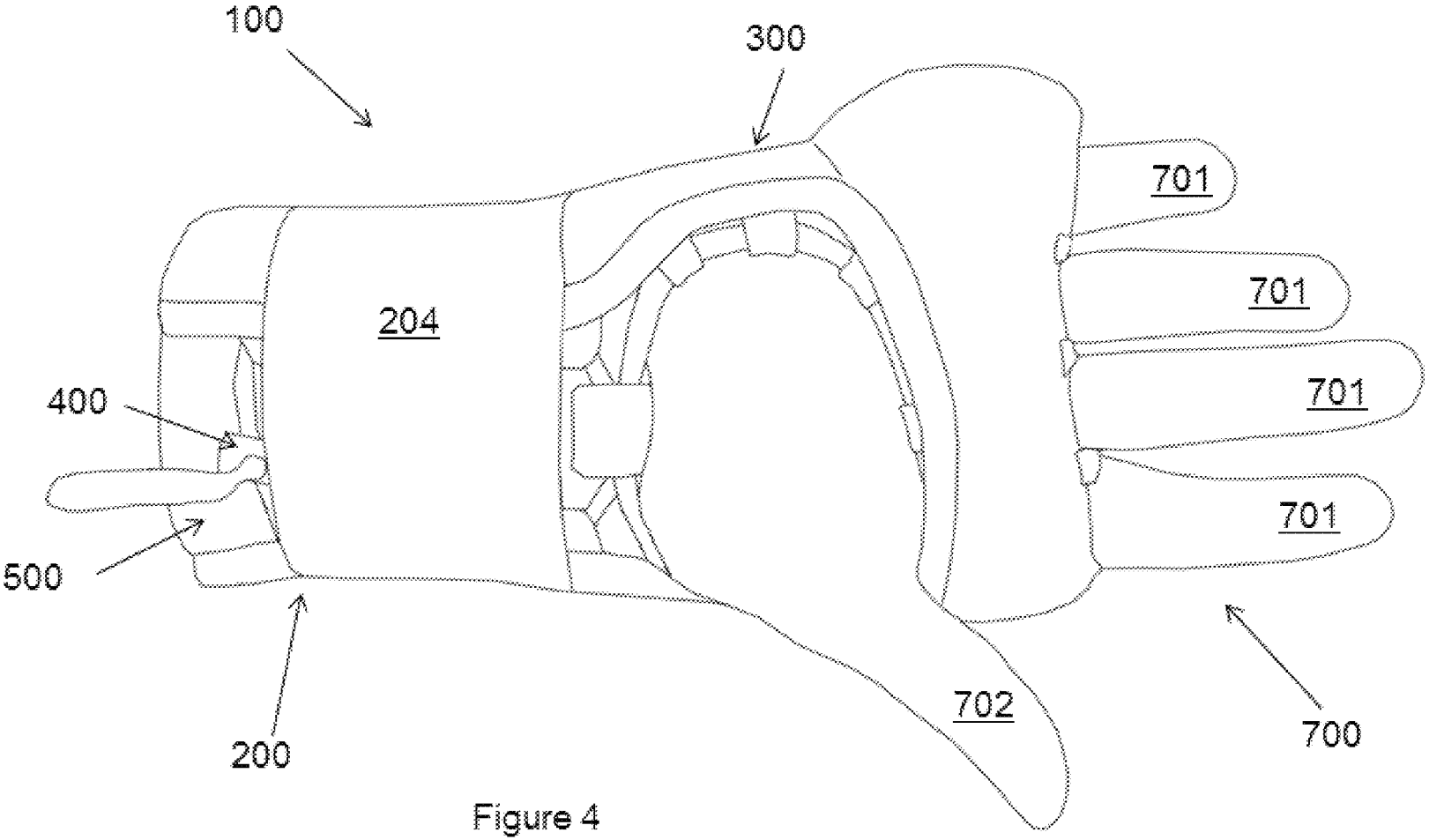
FIG. 4 is a further alternative view of the glove of FIG. 1, shown on a wearer's hand.

FIG. 3 also shows a wrist strap 204 fixedly attached at one end to the wrist covering 201. The wrist strap can be wrapped around the wrist and adjustably attached to either the wrist covering 201 or a topside of the strap 204 itself. The wrist strap 204 further secures the wrist section 200 around a wearer's wrist. The wrist strap 204 may for example comprise a hook or loop fastener on its lower side, and a corresponding loop or hook fastener may be located on the wrist covering 201 or on the topside of the wrist strap 204 itself. FIG. 4 shows an alternative view of the glove 100 on a hand 700, with the wrist strap 204 wrapped around the wrist. The wrist strap 204 may also be used to wrap around the entire outer surface of the glove in a similar manner to the thumb strap as described above. In this manner the wrist strap acts akin to a conventional wrapping and provides further support for the hand. An additional outer wrist strap may be used in addition or instead of the integrated wrist strap 204 described above.

Figure 5:
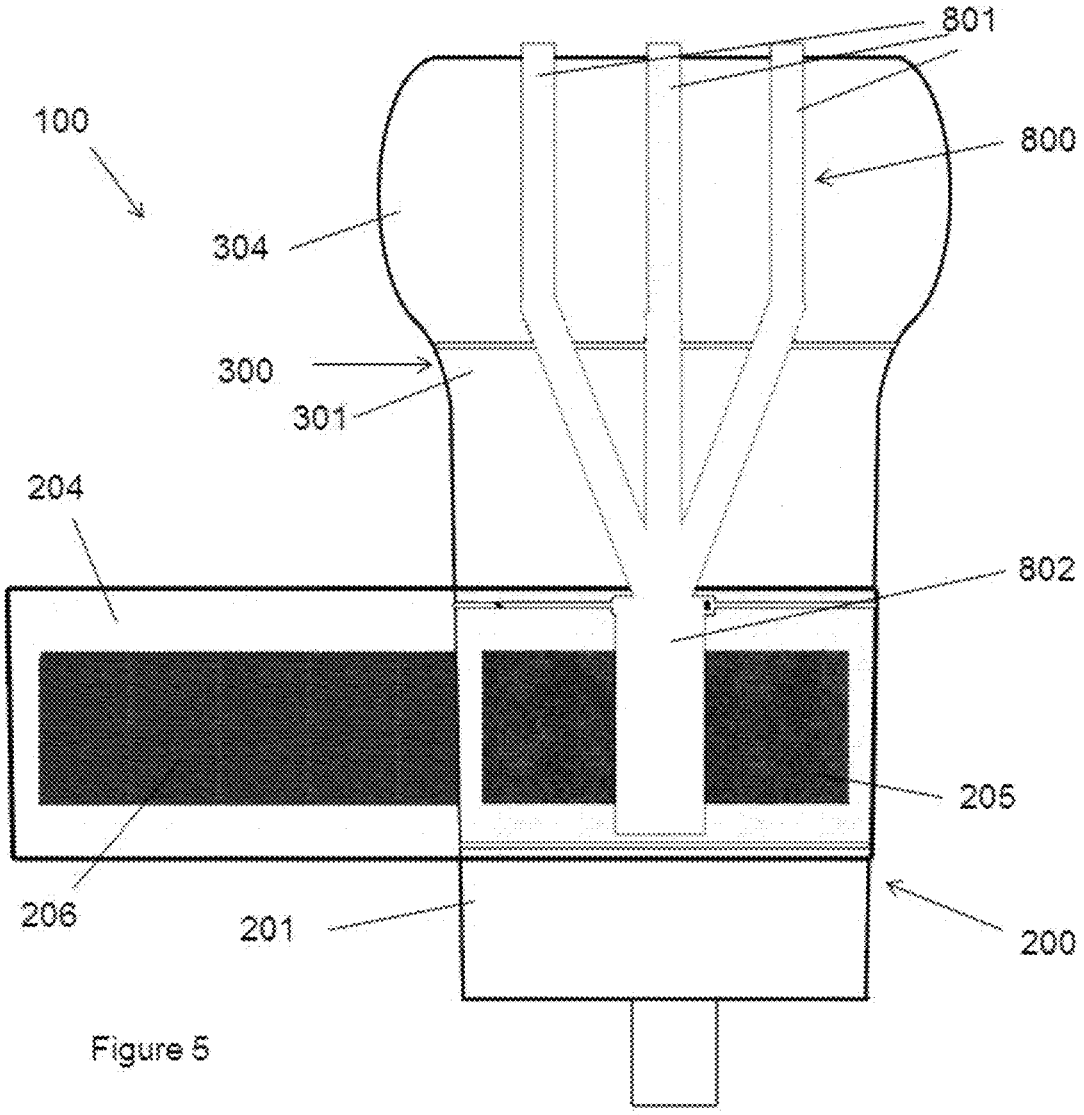
FIG. 5 shows an alternative embodiment of the glove of FIG. 1.
Figure 8:
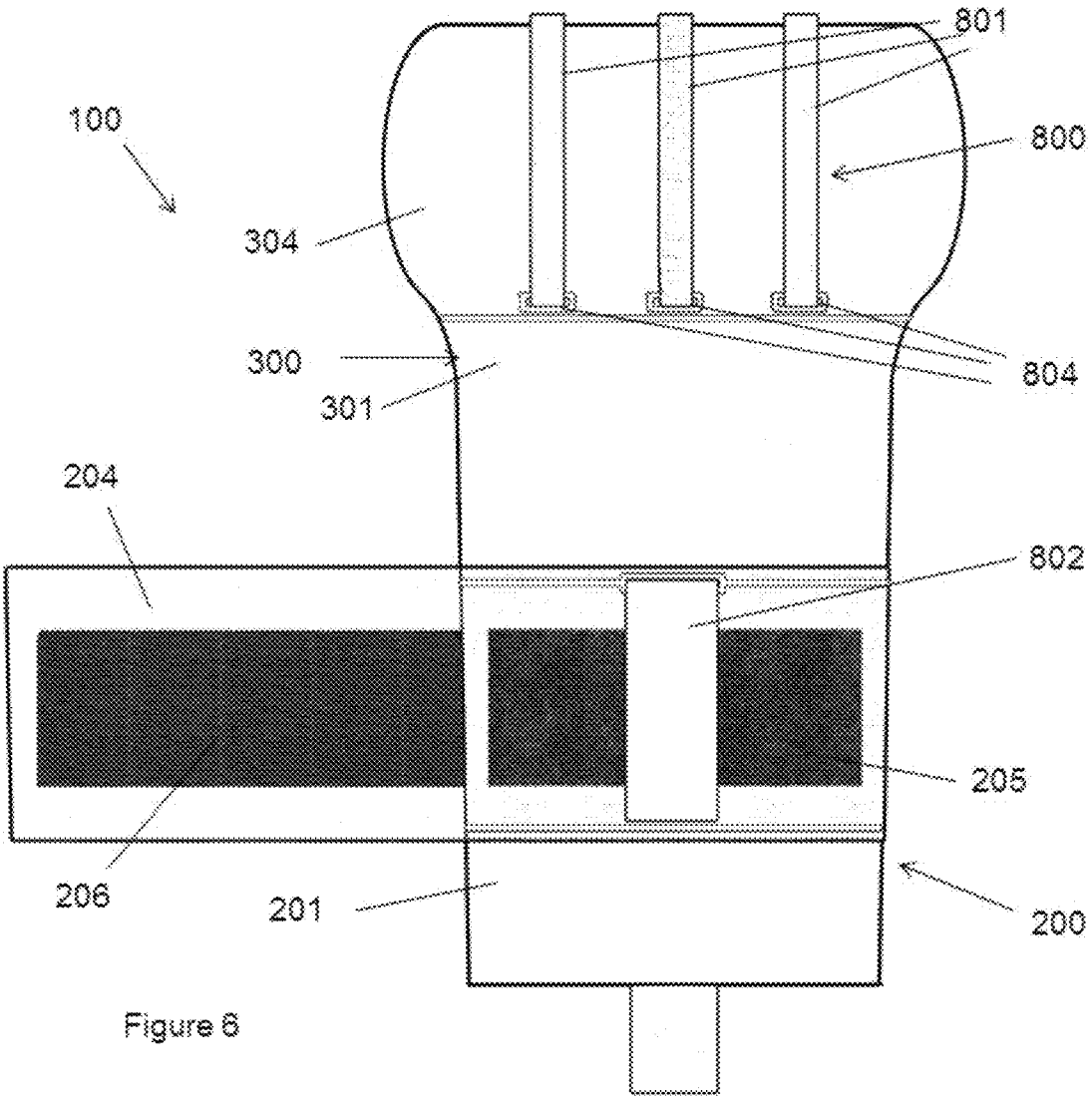

An alternative embodiment of the glove of FIG. 1 with an alternative knuckle compressor 800 is shown in FIG. 5. Knuckle compressor 800 comprises a plurality of straps 801, similar to straps 601, configured to compress the knuckle section 304. The straps 801 conjoin into a further strap 802. Strap 802 can be adjustably attached to the back side of the glove 100.

In the illustrated example, the strap 802 adjustably attaches to the wrist strap 204. The wrist strap 204 comprises a hook or loop fastener 205. A corresponding elongate loop or hook fastener (not shown) on the strap 802 engages the fastener 205. The strap 802 can be attached to the fastener 205 in a range of positions. In particular, pulling the strap 802 away from the hand section 300 also pulls straps 801, compressing the knuckle section 304 under the straps 801. The extent to which the strap 802 is pulled away from the hand section 300 determines the amount of compression applied to the knuckle section 304. The strap 802 may be attached to the fastener 205 in the pulled down position, locking the straps 801 in the compression position.

The hook or loop fastener 205 also acts as a fastener for the wrist strap 204. A corresponding loop or hook fastener 205 on the opposite side of the strap 204 to the fastener 205 can engage with fastener 205 to secure the strap 204 around the wrist.

The straps 801, 802 may run across the back side of the glove 800, as shown in FIG. 5. Alternatively they may pass into the interior of the glove 100, so that they are not visible in use. Such an example is shown in FIG. 6. The straps 801 pass into the interior of the hand section 300 through holes 804. The straps 801 combine to form strap 802 within the material of the glove 100. The strap 802 passes out of the interior through hole 805, so that the wearer can adjust the strap 802 and attach it to the fastener 205.

FIGS. 7*a* and 7*b* show an alternative embodiment of glove 100, comprising a further alternative knuckle compressor 900. The other features of the glove, in particular the hand section 300, wrist section 200, adjustable fastener 400 and tongue 500 are similar to those features shown in FIG. 2 and described above.

FIG. 7*a* shows a palm side view of glove 100, and FIG. 7*b* shows a back side view of glove 100. Similarly to knuckle compressor 600, knuckle compressor 800 comprises one or more (three in the illustrated embodiment) straps 901. One end of each strap 901 is fixedly attached to the back side of the knuckle section 903.

In use, the straps 901 extend from the back side to the palm side of the knuckle section 903, and then wrap around the palm side of the knuckle section and extend to the back side of the knuckle section 304, 903, to which a second end of each strap is adjustably attached as described above for straps 601. Straps 901 may thus double back on themselves, and compress the palm side of knuckle section 304, 903 by wrapping around it. The ends of the straps 901 which are fixedly attached to the back side of the knuckle section 304 may comprise an adjustable fastener for receiving the reciprocal second end of the strap 901—i.e. the adjustably fastened ends of a strap 901 may attach to the strap 901 itself, rather than directly to the back side of knuckle section 901. Hook and loop fasteners can be used to releasably affix the straps.

Straps 901 may also act as finger dividers, separating the fingers and providing a degree of protection against the fingers colliding against each other. Once fastened, the light pressure the straps 901 create in-between the knuckles supports the knuckle structure, forcing the material of the knuckle section 304 to fill the cavity in-between the knuckles. This acts to mitigate damage and bruising to the knuckles caused from the knuckles colliding into each other, which is the primary cause of knuckle damage, rather than from impact.

It may also be considered that the straps act to divide the knuckle section into finger sections. The knuckle section typically comprises a mouthed hoop or ring of material through which fingers of the wearer are placed. The straps act as a stop, preventing the fingers from advancing and securing the glove into place on the user's hand.

It may also be appreciated that although described and shown as extending from a back side of the glove, over the back side of the knuckle section, around the palm side of the knuckle section and secured to the back side of the glove (typically at the back side of the knuckle section), the straps may secure to the palm side of the knuckle section from the rear side of the knuckle section, or they may start at the palm side of the knuckle section and secure to the rear side of the knuckle section.

The straps 601, or 801 and 802, or 901 may be any elongate material, such as cord, lace, wire, or string. Elastic materials may also be used that provide a compression against the knuckle section 301.

The wrist covering 201 and hand covering 301 are preferably formed of a breathable material, such as spacer fabric. Spacer fabric is breathable and does not retain sweat.

In some embodiments the glove, for example glove 100, may comprise splints extending laterally across the back side of the glove, for example across the back side of the hand covering 301 parallel to the knuckles of the user across the metacarpals. The splints may comprise a flexible rubber coating. The splints may act as an exoskeleton, providing extra support to the hand during impact. The splints may particularly be arranged to protect the metacarpals of the wearer, reducing the risk of injury during impact.

Splints may also be provided in the wrist support area 200, such splints may run along the length of the wrist and provide rigidity to the wrist support 200 and protection for the user.

In further embodiments the tongue 500 may be dispensed with and an extended elasticated portion may be used. In such embodiments the comfort and custom fit available with the moveable tongue portion 500 is absent, however the fixed tongue or elasticated cuff provides moderate compression to the wrist and reduces the cost of the overall glove.

It can be appreciated that the various embodiments described above contain complimentary features that may be combined depending upon the need of the user. Accordingly, the gloves 100 described herein therefore provide a customizable and comfortable alternative to hand wrapping for use in combat sports.

Other embodiments are intentionally within the scope of the invention as defined by the appended claims.

The invention claimed is:

1. A protective glove comprising:

a wrist section for protecting a wrist of a wearer of the glove;

a hand section attached to the wrist section for protecting a hand of the wearer of the glove, wherein the hand section comprises a mouthed knuckle section for protecting knuckles of the wearer of the glove, wherein the mouthed knuckle section comprises an opening for receiving the fingers of a wearer, the mouthed knuckle section comprising a hoop or ring of material for surrounding the knuckles of a wearer and the upper portion of a wearer's palm and further comprising a pad of protective material adapted to protect the knuckles of a wearer; and a knuckle compressor configured to compress the knuckle section, wherein the knuckle compressor comprises at least two straps extending between a palm side of the hand section to a back side of the hand section over the knuckle section, the straps configured to compress the knuckle section, and the straps also configured to force the protective material of the knuckle section to fill recesses in-between the knuckles of the wearer, and wherein the straps divide the opening of the mouthed knuckle section into finger sections, each finger section configured to receive one or more fingers of a wearer between the straps, and wherein the compression applied to the knuckle section by the knuckle compressor is adjustable by selectively securing the straps to the back side of the hand section.

2. The protective glove of claim 1, wherein the glove further comprises a wrist-support tongue moveable along the wrist section towards the hand section to a position selected by the wearer, the position of the tongue held during use at least in part by the wrist section.

3. The protective glove of claim 2, wherein the wrist section comprises a wrist covering having a first wrist covering edge and a second wrist covering edge and wherein the tongue extends at least between the first wrist covering edge and the second wrist covering edge.

4. The protective glove of claim 2, further comprising an adjustable fastener for tightening the wrist section around a wrist of a wearer, wherein the tongue is attached to the adjustable fastener.

5. The protective glove of claim 1, wherein the compression applied to the knuckle section is adjustable by adjusting the attachment position of the straps to the back side of the hand section.

6. The protective glove of claim 1, wherein the protective material comprises a non-Newtonian fluid.

7. The protective glove of claim 1, further comprising an adjustable fastener for tightening the wrist section around a wrist of a wearer.

8. The protective glove of claim 7, wherein the wrist section comprises a wrist covering having a first wrist covering edge and a second wrist covering edge, the wrist covering adapted to extend partially around the wrist of a wearer, and wherein the adjustable fastener connects the first wrist covering edge and the second wrist covering edge and is operable to pull the first wrist covering edge and second wrist covering edge towards each other.

9. The protective glove of claim 7, wherein the adjustable fastener comprises:

a lace passing through at least one lace guide on the first wrist covering edge and at least one lace guide of the second wrist covering edge; and a lace fastener preventing movement of the lace through the lace guides, wherein the adjustable fastener is operable to tighten the lace.

10. The protective glove of claim 9, wherein the hand section comprises a hand covering having a first hand covering edge and a second hand covering edge, the hand covering configured to extend partially around the hand of a wearer, and wherein the adjustable fastener connects the first hand covering edge and the second hand covering edge and is operable to pull the first hand covering edge and second hand covering edge towards each other.

11. The protective glove of claim 10, wherein the first hand covering edge and second hand covering edge of the hand covering meet to define a continuous hand covering edge.

12. The protective glove of claim 1, further comprising one or more splints extending laterally across the back side of the hand section.

13. The protective glove of claim 1, wherein the wrist section comprises an elasticated cuff.

* * * * *